US009411266B2

(12) United States Patent
Shinohara et al.

(10) Patent No.: US 9,411,266 B2
(45) Date of Patent: Aug. 9, 2016

(54) DEVELOPER STORAGE CONTAINER

(71) Applicant: Konica Minolta, Inc., Tokyo (JP)

(72) Inventors: Hiroki Shinohara, Tokyo (JP); Hiroshi Takao, Tokyo (JP); Takenori Suenaga, Tokyo (JP); Naoto Tokutake, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/447,509

(22) Filed: Jul. 30, 2014

(65) Prior Publication Data

US 2015/0063876 A1 Mar. 5, 2015

(30) Foreign Application Priority Data

Aug. 29, 2013 (JP) ..... 2013-178078

(51) Int. Cl.
*G03G 15/08* (2006.01)

(52) U.S. Cl.
CPC ..... *G03G 15/0877* (2013.01); *G03G 15/0872* (2013.01)

(58) Field of Classification Search
CPC ..... G03G 15/0867; G03G 15/0877
See application file for complete search history.

(56) References Cited

U.S. PATENT DOCUMENTS

| | | | | |
|---|---|---|---|---|
| 3,196,831 | A * | 7/1965 | Sugarman, Jr. | 399/105 |
| 6,332,065 | B1 * | 12/2001 | Howard | 399/106 |
| 6,671,482 | B2 * | 12/2003 | Dilanni et al. | 399/262 |
| 7,962,064 | B2 * | 6/2011 | Asai | 399/120 |
| 8,478,171 | B2 * | 7/2013 | Sasaki | 399/262 |
| 2006/0024091 | A1 * | 2/2006 | Wegman et al. | 399/262 |
| 2006/0034642 | A1 * | 2/2006 | Taguchi et al. | 399/258 |
| 2007/0077100 | A1 * | 4/2007 | Suzuki et al. | 399/262 |
| 2007/0154243 | A1 * | 7/2007 | Taguchi et al. | 399/258 |
| 2009/0103955 | A1 * | 4/2009 | Takuwa | 399/263 |
| 2009/0129825 | A1 * | 5/2009 | Okino et al. | 399/262 |
| 2009/0279921 | A1 | 11/2009 | Naito et al. | |
| 2009/0324297 | A1 * | 12/2009 | Usui | 399/262 |
| 2010/0226690 | A1 * | 9/2010 | Kadota et al. | 399/262 |

(Continued)

FOREIGN PATENT DOCUMENTS

| | | |
|---|---|---|
| JP | 11-149209 | 6/1999 |
| JP | 2009-271280 | 11/2009 |

(Continued)

OTHER PUBLICATIONS

Notification of Reason for Refusal and English translation from JPO appl. No. 2013-178078, dispatched Aug. 18, 2015, 7 pgs.

(Continued)

*Primary Examiner* — David Bolduc
(74) *Attorney, Agent, or Firm* — Squire Patton Boggs (US) LLP

(57) ABSTRACT

A developer storage container includes a container body, a discharging member, and a regulating member. The regulating member is disposed in a space formed by the container body and the discharging member, and partitions the space into a storage space to store developer in the container body and a discharging side space to store developer to be discharged from a discharging port. Further, the regulating member forms a passage hole to allow developer to pass through and regulates an amount of developer to be conveyed from the storage space to the discharging side space.

10 Claims, 6 Drawing Sheets

(56) References Cited

U.S. PATENT DOCUMENTS

| | | | | |
|---|---|---|---|---|
| 2012/0014713 | A1* | 1/2012 | Murakami et al. | 399/119 |
| 2012/0045244 | A1* | 2/2012 | Komatsu et al. | 399/119 |
| 2012/0163877 | A1* | 6/2012 | Kikuchi et al. | 399/262 |
| 2012/0183333 | A1* | 7/2012 | Ohgoshi et al. | 399/258 |
| 2014/0255058 | A1* | 9/2014 | Salomons et al. | 399/106 |
| 2014/0270859 | A1* | 9/2014 | Hosokawa et al. | 399/262 |
| 2014/0348545 | A1* | 11/2014 | Shiba et al. | 399/258 |
| 2014/0348546 | A1* | 11/2014 | Kojima et al. | 399/258 |
| 2014/0348550 | A1* | 11/2014 | Nagayama et al. | 399/262 |
| 2014/0348551 | A1* | 11/2014 | Yamabe et al. | 399/263 |

FOREIGN PATENT DOCUMENTS

| | | | | |
|---|---|---|---|---|
| JP | 2010-145657 | A | | 1/2010 |
| JP | 2010-066404 | | | 3/2010 |
| JP | 2012048104 | A | * | 3/2012 |

OTHER PUBLICATIONS

Notification of Reason for Refusal and English translation from JPO appl. No. 2013-178078, dispatched Mar. 22, 2016, 6 pgs.

* cited by examiner

DEVELOPER STORAGE CONTAINER

CROSS REFERENCES TO RELATED APPLICATIONS

The present invention contains subject matter related to Japanese Patent Applications JP 2013-178078, filed in the Japanese Patent Office on Aug. 29, 2013, respectively, the entire contents of which being incorporated herein by reference.

The present invention relates to a developer storage container for use in an electro-photographic image forming apparatus, such as a copying machine, a printer, and a facsimile.

BACKGROUND OF THE INVENTION

1. Field of the Invention

In the electro-photographic image forming apparatus, a toner image is formed on an image carrying body such as a photoreceptor and an intermediate transfer belt by a developing section, and the formed toner image is transferred to a sheet by a transferring section. Then, in the image forming apparatus, the toner image transferred to the sheet is fixed to the sheet by a fixing section, whereby an image is formed on the sheet.

Further, in the image forming apparatus, a developer storage container to supply developer to the developing section is mounted. In the developer storage container, developer composed of, for example, toner and carrier is stored. In the widely-used developer storage containers, in many cases, a container body is disposed sideways relative to an image forming apparatus. Furthermore, in the container body, in order to convey developer stored in the container body, a spiral protrusion portion is disposed on the inner circumferential surface of the container body. Then, by rotating the container body, the developer stored in the container body is conveyed to a discharging port disposed on a leading end portion of the container body, and discharged to the developing section.

Further, in order to discharge the conveyed developer from the discharging port efficiently, Patent Document 1 discloses a toner container provided with a conveying blade to scoop up the conveyed developer and to convey the developer to the discharging port.

2. Description of the Related Art

Patent Document 1: Japanese Unexamined Patent Publication No. 2009-271280

However, for example, like the case right after a new developer storage container has been mounted in an image forming apparatus, when a large amount of developer is stored in the container body, an amount of developer conveyed to a discharging port is larger than an amount of developer discharged from the discharging port. Therefore, an amount of developer in a space in the vicinity of the discharging port and the conveying blade becomes larger, and the density of the developer becomes higher. Then, the developer is compressed in the space and the fluidity of the developer lowers. As a result, there has been a problem that it becomes difficult to discharge the developer from the discharging port, right after a new developer storage container has been mounted.

Further, due to an increase in an amount of developer in the space in the vicinity of the discharging port and the conveying blade (an increase in compression ratio), there is a fear that the developer becomes solid and so-called soft aggregation occurs. Subsequently, if the developer in the state of the soft aggregation is used for development, there is a fear that the aggregation of the developer adheres on a sheet and image defects like a so-called firefly phenomenon occur. In particular, in the case where a filling rate of developer to be stored in a container is made to increase in order to reduce a replacement frequency of a developer storage container, a compression rate of developer in the space in the vicinity of the discharging port and the conveying blade becomes high, and the soft aggregation of developer tends to occur easily.

SUMMARY OF THE INVENTION

In consideration of the circumstances in the above conventional techniques, an object of the present invention is to provide a developer storage container that suppresses aggregation of developer in the vicinity of a discharging port and allows the developer to be discharged easily from the discharging port.

In order to solve the above-mentioned problems and to attain the object of the present invention, the developer storage container of the present invention includes a container body, a discharging member, and a regulating member. The container body includes an opening portion. The discharging member is attached to the opening portion and includes a discharging port through which the developer stored in the container body is discharged. The regulating member is disposed in a space formed by the container body and the discharging member, and partitions the space into a storage space to store developer in the container body and a discharging side space to store developer to be discharged from the discharging port. Further, the regulating member forms a passage hole to allow developer to pass from the storage space to the discharging side space and regulates an amount of developer to be conveyed from the storage space to the discharging side space.

In the developer storage container of the present invention, the regulating member regulates an amount of developer to be conveyed from the container body to the discharging port side of the discharging member, whereby it becomes possible to prevent the developer from being compressed in the vicinity of the discharging port and to prevent the fluidity of the developer from lowering.

DESCRIPTION OF THE PREFERRED EMBODIMENTS

Figure 1:
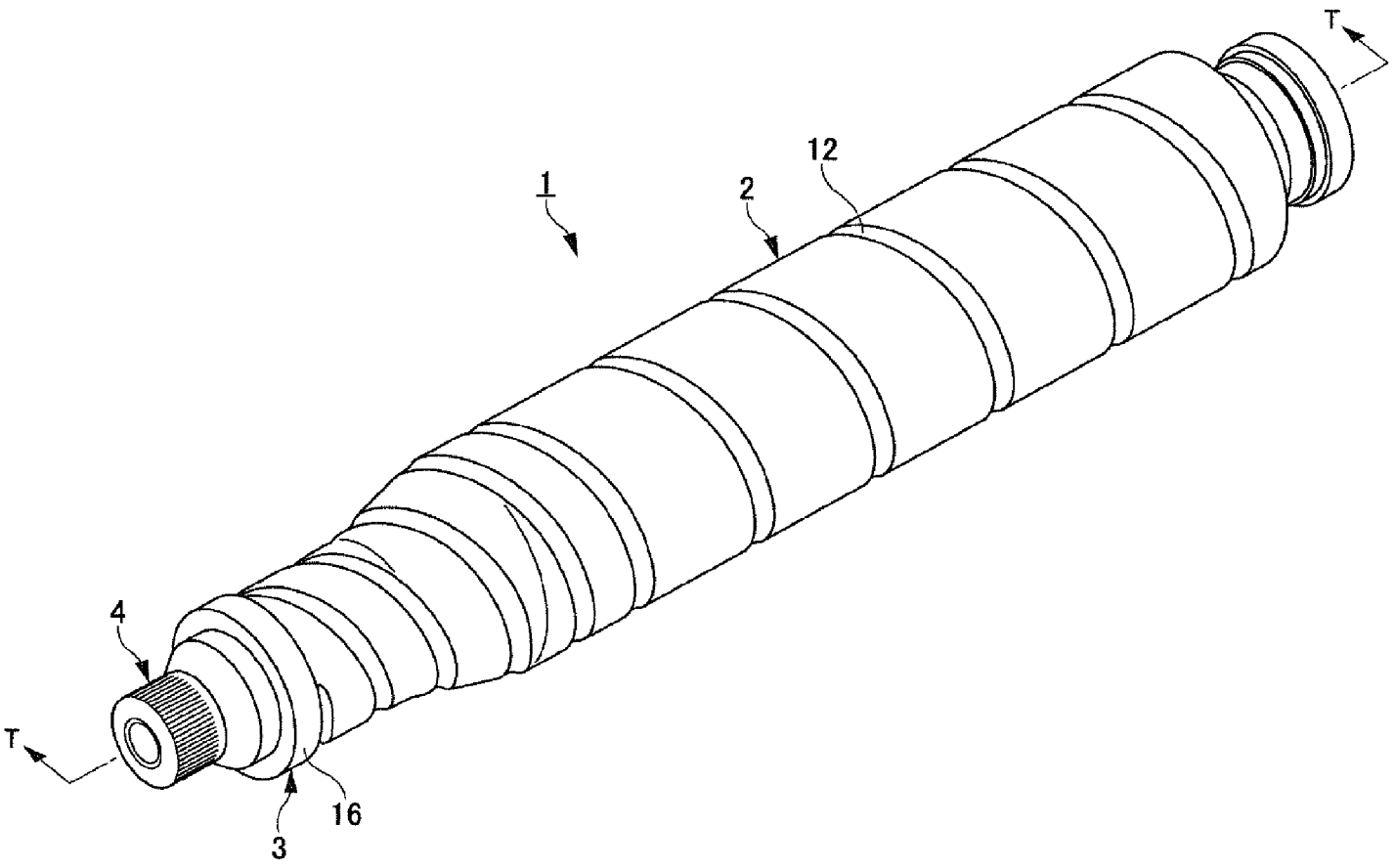
FIG. 1 is a perspective view showing a developer storage container pertaining to an embodiment of the present invention.

Hereafter, description will be given to embodiments to implement a developer storage container with reference to FIGS. 1 to 10. Herein, a common member in each drawing is provided with the same reference numeral.

1. Example of a Constitution of a Developer Storage Container

First, description is given to an example of a constitution of a developer storage container according to an embodiment with reference to FIGS. 1 to 7.

Figure 2:
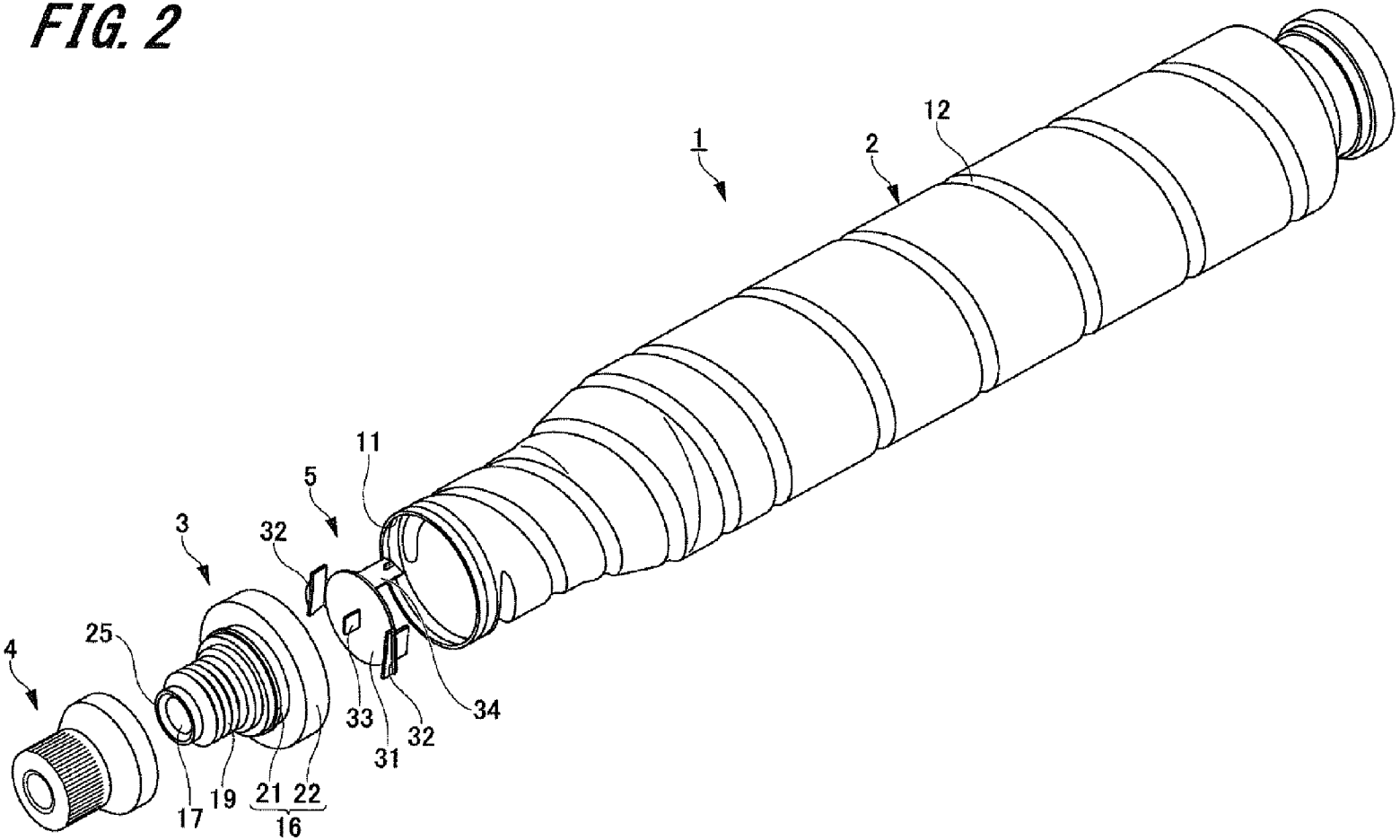
FIG. 2 is an exploded perspective view showing the developer storage container pertaining to the embodiment of the present invention.
Figure 3:
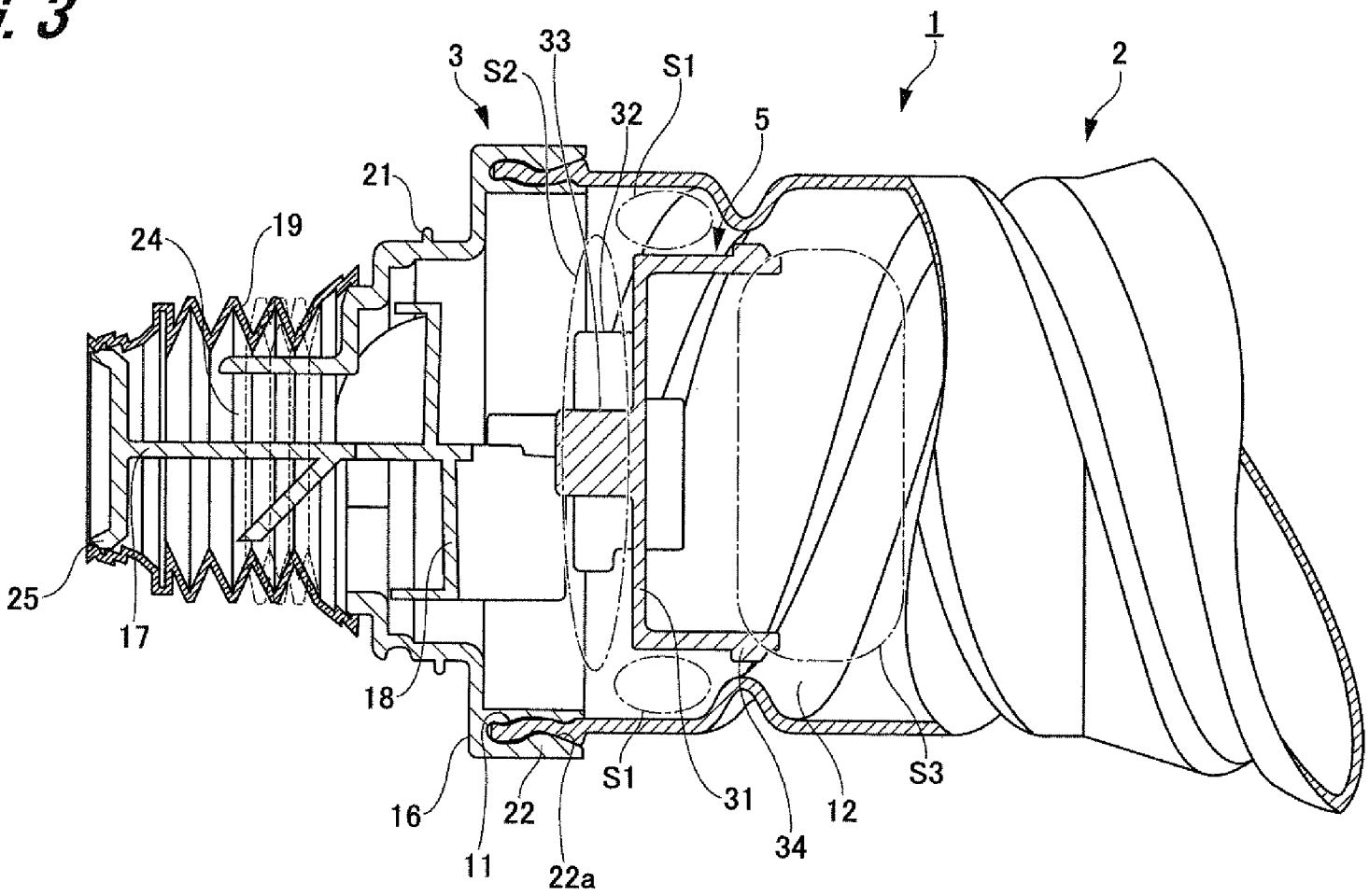
FIG. 3 is a cross sectional view showing the developer storage container pertaining to the embodiment of the present invention.

FIG. 1 is an entire constitution view showing a developer storage container, and FIG. 2 is an exploded perspective view showing the developer storage container. FIG. 3 is a cross sectional view cut along a T-T line shown in FIG. 1. Here, FIG. 3 shows a state in which a cap 4 is removed.

As shown in FIG. 1, a developer storage container 1 is mounted in an electro-photographic image forming apparatus, such as a copying machine, a printer, and a facsimile, and to supply developer composed of toner and carrier to the image forming apparatus. The developer storage container 1 includes a hollow container body 2 to store developer therein, a discharging member 3 to be attached to the container body 2, and a cap 4 to be attached to the discharging member 3. Further, as shown in FIG. 2, the developer storage container 1 includes a regulating member 5 disposed inside the container body 2 and the discharging member 3. Hereinafter, a side of the developer storage container 1 at which the cap 4 and the discharging member 3 are disposed is called a leading end, and a side opposite to the leading end is called a back end.

[Container Body]

As shown in FIG. 2, the container body 2 is formed in a hollow substantially columnar shape, and an opening portion 11 is disposed at its leading end side. Further, on a side wall of the container body 2, a projection portion 12 is formed so as to protrude from the side wall of the container body 2 toward an inner side. The projection portion 12 is formed in a spiral shape from the back end side toward the leading end side of the container body 2. Here, the direction of the spiral of the projection portion 12 is set so as to correspond to the rotation direction of the container body 2.

The container body 2 is mounted in an image forming apparatus with its axial direction being substantially horizontal. Then, when the container body 2 is rotated around its axial direction, the projection portion 12 conveys the developer stored in the container body 2 to the opening portion 11. The discharging member 3 is disposed on the leading end portion of the container body 2.

[Discharging Member]

The discharging member 3 is attached to the container body 2 so as to block the opening portion 11 of the container body 2. As shown in FIG. 3, the discharging member 3 includes a mouth portion 16, a discharging portion 17, a conveying blade 18, and a covering portion 19.

The mouth portion 16 is formed in a cylindrical shape. The mouth portion 16 includes a screw portion 21 disposed at the leading end side of the mouth portion 16 and a locking portion 22 disposed at the back end side of the mouth portion 16. The screw portion 21 is screwed with a screw groove disposed inside the cap 4. A locking groove 22*a* formed from the back end portion toward the leading end portion of the mouth portion 16 is disposed inside the locking portion 22. The leading end portion of the container body 2 is inserted into the locking groove 22*a*. Then, the locking portion 22 is locked with the leading end portion of the container body 2. With the arrangement, the discharging member 3 is rotated integrally with the container body 2. Further, the discharging portion 17 is disposed at the leading end portion of the mouth portion 16.

The discharging portion 17 includes a discharging port 24 through which the developer is discharged out of the container, and a latching portion 25. The latching portion 25 is formed in a substantially circular-plate shape. The leading end portion of the later-mentioned covering portion 19 is temporarily latched to the latching portion 25. The conveying blade 18 is disposed at the back end portion of the discharging portion 17.

The conveying blade 18 is disposed on the discharging portion 17, and arranged in the barrel-shaped hole of the mouth portion 16. The leading end portion of the conveying blade 18 continues to the discharging port 24 of the discharging portion 17, and the back end portion of the conveying blade 18 is positioned close to the inner wall of the mouth portion 16. When the container body 2 and the mouth portion 16 are rotated, the conveying blade 18 scoops up the developer conveyed from the container body 2 and coveys the developer to the discharging port 24 of the discharging portion 17. With the arrangement, even if an amount of developer becomes small, it becomes possible to discharge the developer efficiently from the discharging port 24.

The covering portion 19 is formed as a substantially cylindrical bellows-shaped member. The leading end portion of the covering portion 19 is latched and locked to the latching portion 25 of the discharging portion 17. Further, the back end portion of the covering portion 19 is fixed to the leading end portion of the mouth portion 16.

Under the condition before the developer storage container 1 is mounted in the image forming apparatus, the covering portion 19 covers the discharging port 24 of the discharging portion 17. With the arrangement, before the developer storage container 1 is mounted in the image forming apparatus, it becomes possible to prevent the leakage of developer from the discharging port 24. Further, when the developer storage container 1 is mounted in the image forming apparatus, as shown with one-dot chain line in FIG. 3, the leading end portion of the covering portion 19 is released from the latching portion 25, and shrinks toward the back end portion side. As a result, the discharging port 24 of the discharging portion 17 is exposed.

[Cap]

As shown in FIG. 2, the cap 4 is formed in a hollow substantially truncated cone shape. A not-shown screw groove to be screwed with the screw portion 21 of the mouth portion 16 is disposed on the inner wall of the cap 4. As shown in FIG. 1, under the condition before the developer storage container 1 is used, the cap 4 is attached to the discharging member 3 and covers the covering portion 19 (refer to FIG. 3).

[Regulating Member]

Next, the regulating member 5 is described with reference to FIG. 3, and FIGS. 4 to 7.

Figure 4:
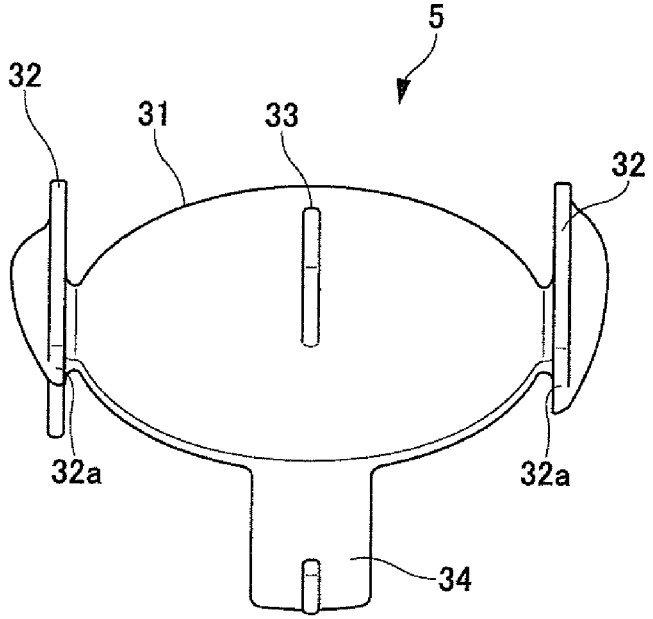
FIG. 4 is a perspective view showing a regulating member in the developer storage container pertaining to the embodiment of the present invention.
Figure 5:
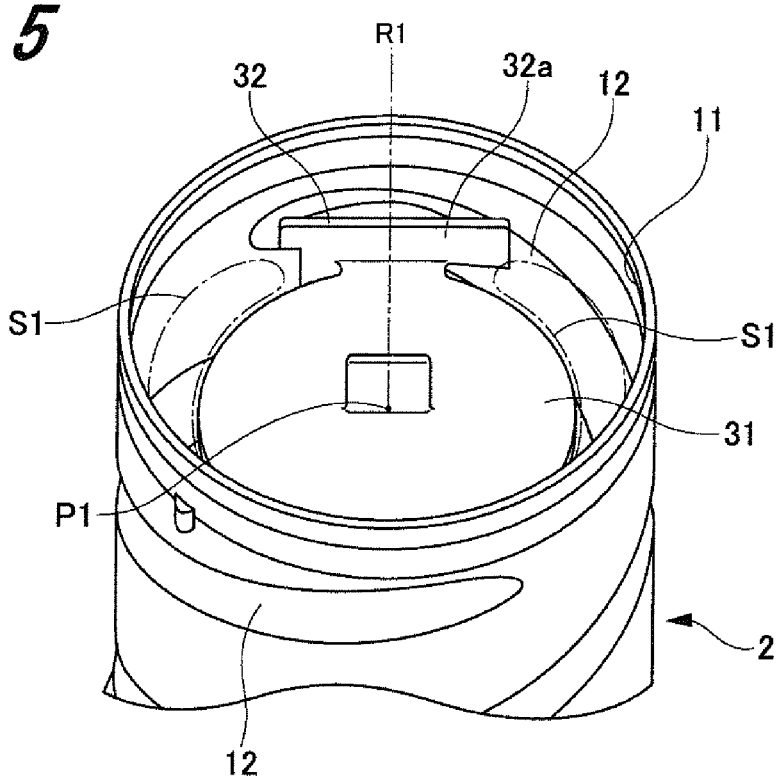
FIG. 5 is a perspective view showing a state where the regulating member is attached to a container body in the developer storage container pertaining to the embodiment of the present invention.
Figure 6:
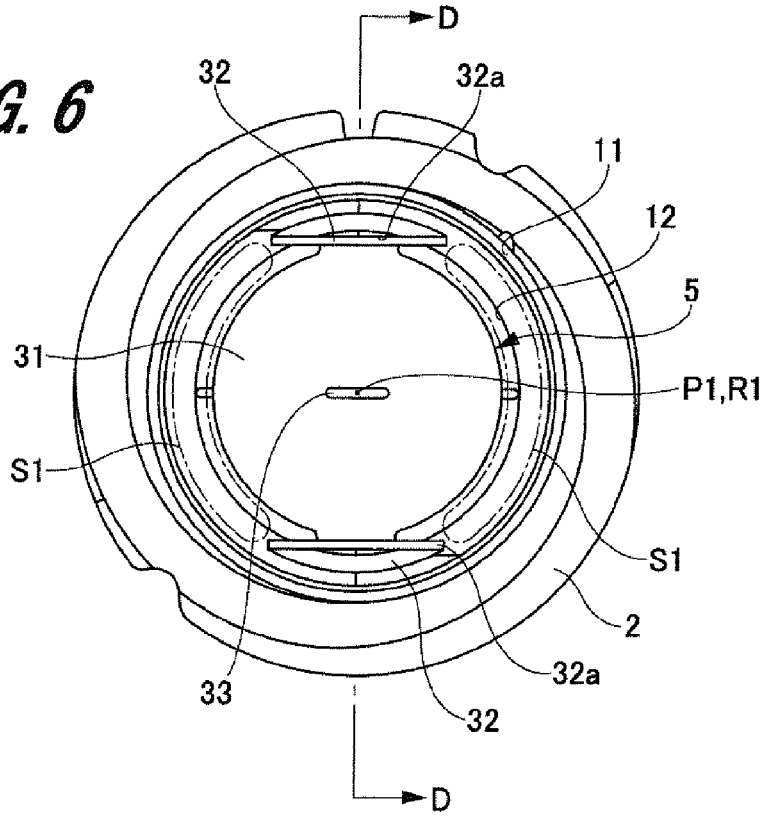
FIG. 6 is a plan view showing a state where the regulating member is attached to the container body in the developer storage container pertaining to the embodiment of the present invention.
Figure 7:
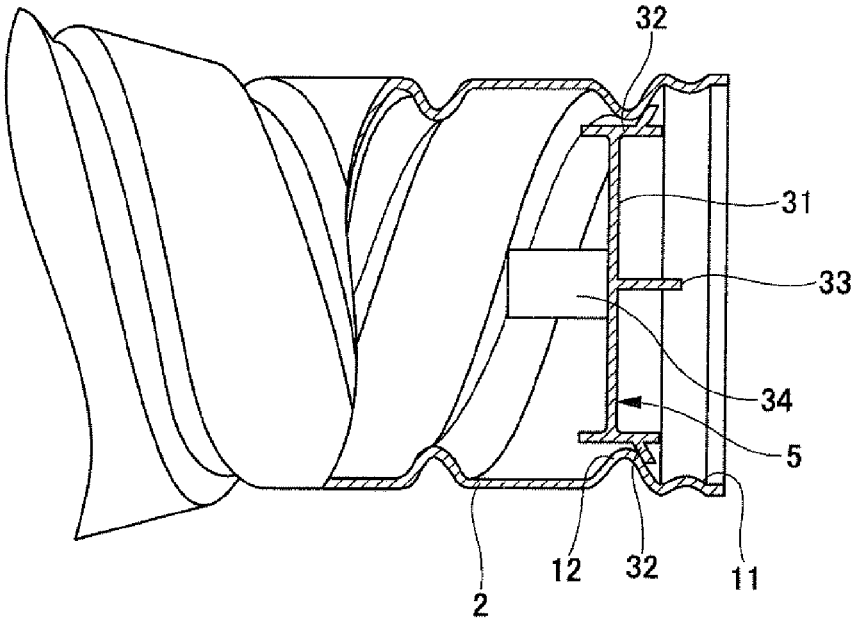
FIG. 7 is a cross sectional view cut along a D-D line shown in FIG. 6.

FIG. 4 is a perspective view showing the regulating member 5. FIG. 5 is a perspective view showing a condition that the regulating member 5 is attached to the container body 2, FIG. 6 is a plan view showing a condition that the regulating member 5 is attached to the container body 2, and FIG. 7 is a cross sectional view cut along a D-D line shown in FIG. 6.

As shown in FIG. 4, the regulating member 5 includes a partitioning portion 31, a pair of engaging portions 32 and 32, a knob portion 33, and a pair of leg portions 34. The partitioning portion 31 is formed in a circular flat-plate shape. As shown in FIG. 6, the diameter of the partitioning portion 31 is set to be smaller than the inside diameter of the container body 2 and the diameter of the opening of the opening portion 11. The knob portion 33 is disposed on one surface of the partitioning portion 31. Further, the pair of engaging portions 32 and 32 and the pair of leg portions 34 are disposed so as to continue to the partitioning portion 31 on the outer edge of the partitioning portion 31.

The pair of engaging portions 32 and 32 is arranged facing each other with the partitioning portion 31 therebetween. Each of the pair of engaging portions 32 and 32 protrudes from the outer edge of the partitioning portion 31 outward in a radial direction of the partitioning portion 31, and substantially vertically to one surface of the partitioning portion 31. As shown in FIGS. 5 and 7, the pair of engaging portions 32 and 32 engages with the projection portion 12 which protrudes from the inner wall of the container body 2 toward an inner side. In detail, the pair of engaging portions 32 and 32 engages with the end portion of the projection portion 12 on the opening portion 11 side. With the arrangement, the regulating member 5 is arranged in the barrel-shaped hole of the container body 2 in the vicinity of the opening portion 11 of the container body 2.

Further, as shown in FIGS. 4 and 5, the pair of engaging portions 32 and 32 is provided with contact pieces 32*a* and 32*a*, respectively. When the pair of engaging portions 32 and 32 engages with the projection portion 12, the contact pieces 32*a* are brought in contact with the inner wall of the container body 2. Therefore, when the container body 2 is rotated, the regulating member 5 is also rotated integrally with the container body 2.

As shown in FIG. 4, a pair of leg portions 34 and 34 is arranged facing each other with the partitioning portion 31 therebetween. The pair of leg portions 34 and 34 is positioned on the outer edge of the partitioning portion 31 between the pair of engaging portions 32 and 32. Further, the pair of leg portions 34 and 34 bends substantially vertically from the outer edge of the partitioning portion 31. As shown in FIG. 7, when the regulating member 5 is attached to the container body 2, each of the pair of leg portions 34 and 34 protrudes from the opening portion 11 towards the back end side of the container body 2.

With the constitution that each of the pair of leg portions 34 and 34 comes in contact with the inner wall of the container body 2, when the regulating member 5 is attached to the container body 2, it becomes possible to prevent the regulating member 5 from falling inside the container body 2. Further, with the constitution that each of the pair of leg portions 34 and 34 comes in contact with the inner wall of the container body 2, it becomes possible to prevent the regulating member 5 from tilting or rotating with the pair of engaging portions 32 and 32 as a fulcrum in the container body 2.

The knob portion 33 is a protruding portion which protrudes from one surface of the partitioning portion 31 toward a side opposite to the protruding direction of the leg portions 34. When the regulating member 5 is attached to the container body 2, the knob portion 33 is nipped by an operator. This facilitates an attaching operation of the regulating member 5.

Here, even if the pair of leg portions 34 and 34 and the knob portion 33 are not disposed, the object of the present invention can be attained.

As shown in FIG. 6, when the regulating member 5 is attached to the container body 2, the center portion of the partitioning portion 31 in the radial direction substantially coincides with the center portion of the barrel-shaped hole in the radial direction in the container body 2. That is, a center P1 of the partitioning portion 31 of the regulating member 5 in the radial direction coincides with a rotation axis R1 in the container body 2.

Further, as mentioned above, the diameter of the partitioning portion 31 is set to be smaller than the inner diameter of the container body 2 and the diameter of the opening of the opening portion 11. Therefore, as shown in FIGS. 5 and 6, passage holes S1 to allow a predetermined amount of developer pass through are formed between the outer edge of the partitioning portion 31 and the inner wall of the container body 2.

Further, the partitioning portion 31 is formed in a circular shape, and the pair of engaging portions 32 and 32 is arranged symmetrically to each other with the partitioning portion 31 therebetween. Therefore, the size of an opening of the passage hole S1, i.e., a distance between the outer edge of the partitioning portion 31 and the inner wall of the container body 2 is formed to be constant except portions where the pair of engaging portions 32 and 32 is disposed.

Furthermore, as shown in FIG. 3, one surface of the partitioning portion 31 of the regulating member 5 is separated from the conveying blade 18 of the discharging member 3 with a predetermined distance in the axial direction of the container body 2. Therefore, a discharging side space S2 is formed between the partitioning portion 31 of the regulating member 5 and the conveying blade 18. As a result, an inner space formed by the container body 2 and the discharging member 3 in the developer storage container 1 is divided into a storage space S3 in which developer is stored in the container body 2 and a discharging side space S2 formed by the regulating member 5 and the conveying blade 18 of the discharging member 3.

Here, in the present embodiment, description is given to the example where the passage hole S1 to allow developer to pass through is formed by a gap between the outer edge of the partitioning portion 31 and the inner wall of the container body 2. However, the present invention is limited to the example, and the passage hole S1 to allow developer to pass through may be formed on the partitioning portion 31 itself.

Further, in the present embodiment, description is given to the example where the regulating member 5 is made to engage with the container body 2, and the regulating member 5 is made to be another member separated from the container body 2 and the discharging member 3. However, the present invention is limited to the example. That is, for example, the regulating member 5 may be integrally formed with the container body 2 or the discharging member 3 by integral molding. Further, the regulating member 5 may be fixed to the mouth portion 16 of the discharging member 3, or, the regulating member 5 may be fixed to the conveying blade 18 of the discharging member 3. Here, in the case where the regulating member 5 is fixed to the conveying blade 18, there is a need to dispose a space between the regulating member 5 and a portion where the conveying blade 18 scoops up developer.

2. Discharging Action of Developer

Next, description is given to a discharging action of the developer in the developer storage container 1 with the above-mentioned constitution.

Here, in the developer storage container 1, developer is filled up beforehand in the container body 2, and the regulating member 5 is attached. Then, the cap 4 is removed from the discharging member 3, and the developer storage container 1 is rotatably mounted in an image forming apparatus under a condition that the axial direction of the container body 2 is directed substantially horizontally. At this time, when the developer storage container 1 is mounted, the leading end portion of the covering portion 19 is detached from the latching portion 25 in conjunction with the mounting, and the covering portion shrinks toward the back end portion side to expose the discharging port 24 of the discharging portion 17.

First, when the container body 2 is rotated around its axial direction, the discharging member 3 is also rotated integrally with the container body 2. Then, the developer stored in the container body 2 is conveyed by the projection portion 12 toward the discharging member 3 side. In the example, as shown in FIG. 3, the regulating member 5 is disposed in the vicinity of the opening portion 11 of the container body 2. Accordingly, the developer conveyed by the projection portion 12 is brought into contact with the partitioning portion 31 in the regulating member 5, so that further conveyance is regulated. Then, a predetermined amount of the developer corresponding to the size of the opening of the passage hole S1 passes through the passage hole S1 formed by the partitioning portion 31. In this way, the regulating member 5 regulates an amount of the developer conveyed out from the storage space S3 to the discharging side space S2, and maintains the density of the developer in the discharging side space S2 at a predetermined value or less.

Subsequently, the developer conveyed out to the discharging side space S2 is scooped up by the conveying blade 18 of the discharging member 3 and conveyed to the discharging port 24 of the discharging portion 17. Then, the developer is discharged from the discharging port 24.

Further, when the developer storage container 1 is mounted in the image forming apparatus, the regulating member 5 regulates an amount of the developer conveyed out to the discharging side space S2 as follows. The regulating member 5 regulates the amount of the developer such that a height from the lowest point of the discharging side space S2 in the developer in the discharging side space S2 becomes lower than a height from the lowest point of the storage space S3 in the developer filled up in the storage space S3. In this way, the density of the developer in the discharging side space S2 is maintained at a constant value or less by the regulating member 5, whereby it becomes possible to prevent the developer from being compressed in the discharging side space S2 in the vicinity of the conveying blade 18 or the discharging port 24. Therefore, it becomes possible to prevent the developer from becoming hard to be discharged from the discharging port 24, which facilitates discharge of the developer from the discharging port 24.

Further, since it becomes possible to suppress occurrence of soft aggregation of the developer in the discharging side space S2 by preventing the developer from being compressed in the discharging side space S2, it becomes possible to prevent occurrence of image defects.

The regulating member 5 regulates an amount of the developer conveyed out to the discharging side space S2 to become almost equal to an amount of the developer discharged from the discharging member 3, whereby an amount of the developer accumulated in the discharging side space S2 can be kept always constant. This makes it possible to maintain an amount of the developer discharged from the discharging port 24 always constant.

Further, as shown in FIGS. 5 and 6, the partitioning portion 31 is formed in a circular shape, arranged at substantially the center of the barrel-shaped hole in the radial direction in the container body 2, and arranged substantially concentrically with the barrel-shaped hole in the container body 2. Therefore, a distance between the outer edge of the partitioning portion 31 and the inner wall of the container body 2 is made constant except portions where the pair of engaging portions 32 and 32 is disposed. This makes it possible to discharge a fixed amount of the developer from the passage holes S1 to the discharging side space S2 at all times, when the container body 2 is rotated. As a result, it becomes possible to minimize a difference between an amount of the developer discharged from the discharging port 24 right after the developer storage container 1 has been exchanged and an amount of the developer discharged from the discharging port 24 when an amount of developer stored in the container body 2 becomes small, which enables stable supply at all times.

Furthermore, the passage hole S1 to allow the developer to pass through is formed along the inner wall surface of the container body 2. Here, in the case where an amount of developer stored in the container body 2 becomes small, the developer moves toward the inner wall surface side of the container body 2 with the centrifugal force caused by the rotation of the container body 2. Therefore, even if the remaining amount of developer stored in the container body 2 becomes small, the developer can be conveyed out from the storage space S3 to the discharging side space S2 by utilizing the centrifugal force caused by the rotation of the container body 2. This makes it possible to discharge the developer stored in the container body 2 from the discharging port 24 without leaving the developer.

3. Modification Example of the Regulating Member

Figure 8:
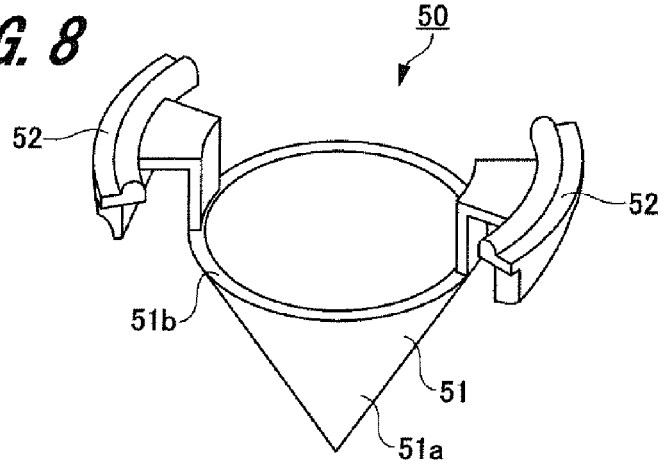
FIG. 8 is a perspective view showing a first modification example of the regulating member in the developer storage container pertaining to the embodiment of the present invention.
Figure 9:
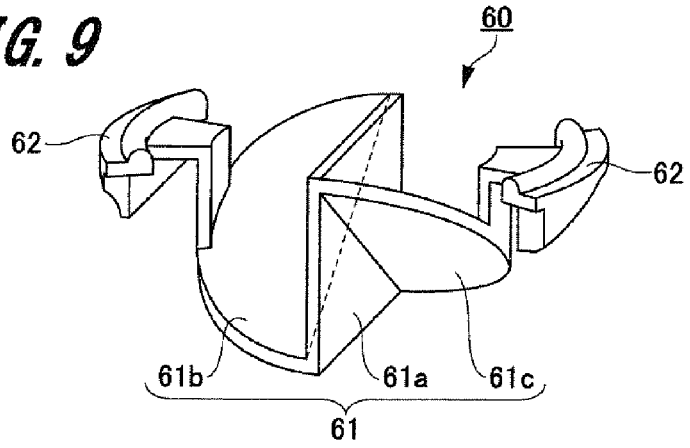
FIG. 9 is a perspective view showing a second modification example of the regulating member in the developer storage container pertaining to the embodiment of the present invention.
Figure 10:
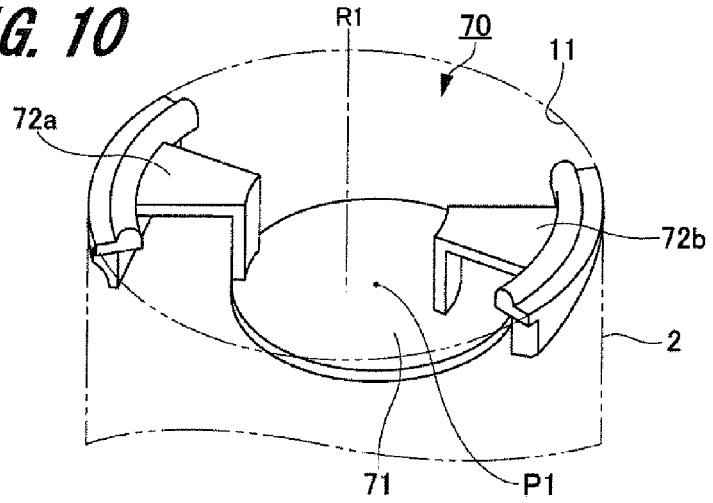
FIG. 10 is a perspective view showing a third modification example of the regulating member in the developer storage container pertaining to the embodiment of the present invention.

Next, description is given to the modification examples of the regulating member with reference to FIGS. 8 to 10.

[First Modification Example]

First, the first modification example of the regulating member is described with reference to FIG. 8.

FIG. 8 is a perspective view of a regulating member 50 pertaining to the first modification example.

The regulating member 50 pertaining to the first modification example differs from the regulating member 5 shown in FIG. 4 in a constitution of a partitioning portion.

As shown in FIG. 8, the regulating member 50 includes a partitioning portion 51 and a pair of engaging portions 52 and 52. The partitioning portion 51 is formed in a substantially conical shape. The regulating member 50 is arranged such that the apex of the cone on the partitioning portion 51 faces toward the storage space S3 side in the developer storage container 1.

According to the regulating member 50 pertaining to the first modification example, the developer conveyed from the storage space S3 comes in contact with an inclined surface 51*a* of the partitioning portion 51. Successively, the developer is conveyed along the inclined surface 51*a* of the partitioning portion 51 to an end portion 51*b* of the partitioning portion 51. This makes it possible to efficiently convey out the developer from the passage holes S1 formed by the partitioning portion 51 and the container body 2 or the inner wall of the discharging member 3.

As shown in the regulating member 50 pertaining to the first modification example and the regulating member 5 pertaining to the first embodiment, the shape of the partitioning portion is not limited to a circular flat-plate shape or a conical shape. Further, in addition to the circular flat-plate shape and the conical shape, examples of the shape of the partitioning portion include various kinds of shape, such as a polygonal flat-plate shape and a sphere shape.

[Second Modification Example]

FIG. 9 is a perspective view of a regulating member 60 pertaining to the second modification example.

The regulating member 60 pertaining to the second modification example differs from the regulating member 5 shown in FIG. 4 in a constitution of a partitioning portion.

As shown in FIG. 9, the regulating member 60 includes a partitioning portion 61 and a pair of engaging portions 62 and 62. The partitioning portion 61 includes a rectangular connecting plate 61*a* and a pair of inclined plates 61*b* and 61*c*. The connecting plate 61*a* is arranged such that its one surface and another surface are made substantially parallel to the axial direction of the container body 2 or the discharging member 3 (refer to FIG. 2).

The first inclined plate 61*b* is disposed on one surface of the connecting plate 61*a*, and the second inclined plate 61*c* is disposed on another surface of the connecting plate 61*a*. The first inclined plate 61*b* is arranged along a diagonal line of the connecting plate 61*a*, and is made to incline relative to the axial direction of the container body 2 or the discharging member 3. The second inclined plate 61*c* is arranged along another diagonal line of the connecting plate 61*a* different from the diagonal line for the first inclined plate 61*b*. Further, the second inclined plate 61*c* is made to incline in an inclining direction different from that of the first inclined plate 61*b* relative to the axial direction of the container body 2 or the discharging member 3.

According to the regulating member 60 pertaining to the second modification example, the developer conveyed from the storage space S3 comes in contact with the first inclined plate 61*b* or the second inclined plate 61*c* of the partitioning portion 61. Successively, the developer is conveyed along the inclined surface of the first inclined plate 61*b* or the second inclined plate 61*c* to the passage holes S1. This makes it possible to efficiently convey out the developer from the passage holes S1 formed by the partitioning portion 51 and the container body 2 or the inner wall of the discharging member 3.

[Third Modification Example]

FIG. 10 is a perspective view of a regulating member 70 pertaining to the third modification example.

The regulating member 70 pertaining to the third modification example differs from the regulating member 5 shown in FIG. 4 in a position of a partitioning portion.

As shown in FIG. 10, the regulating member 70 includes a partitioning portion 71 formed in a circular flat-plate shape and a pair of engaging portions 72*a* and 72*b*. The first engaging portion 72*a* is disposed on the outer edge of the partitioning portion 71. The second engaging portion 72*b* faces the first engaging portion 72*a* with the partitioning portion 71 therebetween. Further, the second engaging portion 72*b* is disposed so as to continue from one surface of the partitioning portion 71.

Further, when the regulating member 70 is attached to the container body 2, since the partitioning portion 71 is disposed eccentrically in a radial direction to one side in the barrel-shaped hole of the container body 2, the center P1 of the partitioning portion 71 in the radial direction does not coincide with the rotation axis R1 of the container body 2. Accordingly, the distance between the passage holes S1 formed by the partitioning portion 71 and the inner wall surface of the container body 2 changes along the circumferential direction of the partitioning portion 71.

However, since the regulating member 70 is rotated together with the container body 2, the distances between the passage holes S1 are averaged. Therefore, even if the partitioning portion 71 is disposed eccentrically in a radial direction to one side relative to the rotation axis R1, the effect similar to that in the regulating member 5 pertaining to the above-mentioned first embodiment can be attained.

In the above, description is given to the embodiments of the developer storage container including their functions and effects. However, the developer storage container of the present invention should not be limited to the above-mentioned embodiments. Various modified embodiments can be achieved within a rage where the modified embodiments do not deviate from the intention of the invention described in the scope of claims.

It should be understood by those skilled in the art that various modifications, combinations, sub-combinations and alterations may occur depending on design requirements and other factors insofar as they are within the scope of the appended claims or the equivalents thereof.

What is claimed is:

1. A developer storage container, comprising:

a container body including an opening portion;

a discharging member attached to the opening portion and including a discharging port through which a developer stored in the container body is discharged; and a regulating member disposed in a space formed by the container body and the discharging member, and configured to partition the space into a storage space to store the developer in the container body and a discharging side space to store the developer to be discharged from the discharging port, wherein the regulating member forms a passage hole to allow the developer to pass from the storage space to the discharging side space and regulates an amount of the developer to be conveyed from the storage space to the discharging side space, wherein the regulating member includes a partitioning portion configured to partition the storage space and the discharging side space and to come in contact with the developer conveyed from the storage space, and wherein the passage hole has a first side and a second side facing toward the first side, the first side is formed by the partitioning portion, and the second side is formed by either the container body or an inner wall surface of the discharging member.

2. The developer storage container according to claim 1, wherein the partitioning portion is formed in a circular flat-plate shape, and an edge of the circular flat shape forms the first side of the passage hole.

3. The developer storage container according to claim 2, wherein the container body is rotatably mounted to an image forming apparatus, and wherein the regulating member is arranged at a position where a center of the partitioning portion in a radial direction coincides with a rotation axis of the container body.

4. The developer storage container according to claim 1, wherein the regulating member includes an engaging portion engaged to the container body or the discharging member.

5. The developer storage container according to claim 4, wherein the container body includes a projection portion which is formed in a spiral shape and configured to convey the developer to the opening portion, and wherein the engaging portion is engaged to the spiral shape.

6. The developer storage container according to claim 1, wherein the container body includes a projection portion which is formed in a spiral shape and configured to convey the developer to the opening portion, and wherein the regulating member is integrally formed with the container body or the discharging member.

7. The developer storage container according to claim 1, wherein the discharging member includes a conveying blade configured to scoop up the developer and convey the developer to the discharging port, and wherein the regulating member is provided at or engaged to the conveying blade.

8. The developer storage container according to claim 1, wherein the container body stores the developer.

9. The developer storage container according to claim 1, wherein the discharging member includes a conveying blade configured to scoop up the developer and convey the developer to the discharging port, and wherein one surface of the partitioning portion is separated from the conveying blade with a predetermined distance in an axial direction of the container body.

10. The developer storage container according to claim 1, wherein one surface of the partitioning portion is separated from the discharging port with a predetermined distance in an axial direction of the container body.

* * * * *